US009179782B2

(12) United States Patent
Schiller

(10) Patent No.: US 9,179,782 B2
(45) **Date of Patent: *Nov. 10, 2015**

(54) PERIMETER-WRAPPED MATTRESS AND METHOD OF MANUFACTURE

(71) Applicant: Stephen J. Schiller, Naples, FL (US)

(72) Inventor: Stephen J. Schiller, Naples, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/568,242

(22) Filed: Dec. 12, 2014

(65) Prior Publication Data

US 2015/0096127 A1 Apr. 9, 2015

Related U.S. Application Data

(63) Continuation-in-part of application No. 13/458,022, filed on Apr. 27, 2012, now Pat. No. 8,955,182.

(51) Int. Cl.

| | |
|---|---|
| ***A47C 27/15*** | (2006.01) |
| ***A47C 27/00*** | (2006.01) |
| ***A47C 27/05*** | (2006.01) |

(52) U.S. Cl.

CPC ..... *A47C 27/15* (2013.01); *A47C 27/002* (2013.01); *A47C 27/056* (2013.01)

(58) Field of Classification Search

CPC .. A47C 27/002; A47C 27/003; A47C 27/008; A47C 27/045; A47C 31/02

USPC ..... 5/690, 717, 737, 739, 740; 29/91, 91.1, 29/91.5

See application file for complete search history.

(56) References Cited

U.S. PATENT DOCUMENTS

| | | | | |
|---|---|---|---|---|
| 1,559,708 | A | 11/1925 | Kelsey | 5/696 |
| 2,326,441 | A * | 8/1943 | Cunningham | 5/737 |
| 2,826,769 | A | 3/1958 | Gustav | 5/717 |
| 3,737,929 | A * | 6/1973 | Golembeck | 5/739 |
| 3,848,283 | A * | 11/1974 | Ikeda | 5/717 |
| 5,065,485 | A | 11/1991 | Zocco | 29/91.1 |
| 5,133,116 | A | 7/1992 | Wagner et al. | |
| 6,568,014 | B1 | 5/2003 | Sabalaskey et al. | |
| 6,662,393 | B2 | 12/2003 | Boyd | |
| 6,874,215 | B2 * | 4/2005 | Flippin | 29/91.1 |
| 7,147,106 | B2 | 12/2006 | Kowalski et al. | |
| 7,191,483 | B2 | 3/2007 | Hochschild | 5/740 |
| 7,386,903 | B2 | 6/2008 | Hochschild | |
| 7,484,282 | B2 | 2/2009 | Flippin | 29/91.1 |
| 7,617,556 | B2 | 11/2009 | Rensink | 5/739 |
| 7,631,381 | B2 * | 12/2009 | Flippin | 5/739 |
| 7,644,461 | B2 | 1/2010 | Lee | |
| 8,074,313 | B2 * | 12/2011 | Marcangelo | 5/737 |
| 8,776,295 | B2 | 7/2014 | Myers et al. | 5/737 |
| 8,800,082 | B2 * | 8/2014 | Kluft et al. | 5/717 |
| 8,955,182 | B1 * | 2/2015 | Schiller et al. | 5/739 |
| 2003/0000021 | A1 | 1/2003 | O'Connell et al. | |
| 2006/0059631 | A1 * | 3/2006 | Rensink | 5/739 |
| 2011/0191962 | A1 | 8/2011 | Frame | |

FOREIGN PATENT DOCUMENTS

| | | |
|---|---|---|
| GB | 880079 | 10/1961 |
| GB | 880079 A * | 10/1961 |
| GB | 920161 | 3/1963 |

* cited by examiner

*Primary Examiner* — Michael Trettel

(74) *Attorney, Agent, or Firm* — Livingston Loeffler, P.A.; Bryan L. Loeffler, Esq.; Edward M. Livindston, Est.

(57) ABSTRACT

A mattress (22) having a core structure (8) wherein side walls (15) are compressed inward and held in place using a preferably non-woven strip of fabric (21) or similar non-elastic or non-stretchable material that is wrapped around the side walls.

21 Claims, 5 Drawing Sheets

PERIMETER-WRAPPED MATTRESS AND METHOD OF MANUFACTURE

CROSS REFERENCE TO RELATED APPLICATION

This application claims the benefit of U.S. patent application Ser. No. 13/458,022, filed Apr. 27, 2012, now U.S. Pat. No. 8,955,182. The patent application identified above is incorporated herein by reference in its entirety to provide continuity of disclosure.

FIELD OF THE INVENTION

This invention relates to mattresses, more particularly, a mattress wrapped with a non-elastic or a non-stretchable material, such as a non-woven cloth.

BACKGROUND OF THE INVENTION

Mattresses are designed for pressure management and comfort. When an individual lies on a mattress, the internal support structure should distribute the individual's body weight evenly across the entire sleeping surface to reduce uncomfortable pressure points. Conventional mattresses are typically constructed using layers of foam and/or springs. Mattresses traditionally require a foam encasement comprising foam panels that create a frame around the core structure of the mattress. There are three common reasons conventional mattresses are made with a foam encasement. The first is to shape the corners of the mattress. The second is to provide lateral support to the mattress core structure to prevent the mattress core structure from spreading under the weight of an individual and failing to provide proper support. The third is to provide a sitting edge on the mattress that is sturdy enough to hold an individual sitting on the edge of the mattress.

Such conventional foam encasements are typically two to four inches wide and are constructed out of a polyurethane foam having a density greater than that of the typically latex core structure, thereby creating a dense uncomfortable ridge around the perimeter edge of the mattress. In addition, polyurethane foam commonly breaks down over time, thereby becoming softer and failing to provide a sturdy sitting edge. An even further problem with foam encasements is that the foam is flexible, thereby allowing the core structure and internal support structure to spread under a user's weight, thereby pushing the foam encasement outward and flattening the mattress.

Therefore, a need exists for a mattress constructed using a method that strengthens conventional mattresses, thereby providing long lasting comfort.

SUMMARY OF THE INVENTION

The primary object of the present invention is to provide a mattress constructed using a method and system that strengthens conventional spring coil and foam encased mattresses and prevents flattening of the core structure, thereby ensuring the mattress retains its shape.

The present invention fulfills the above and other objects by providing a mattress constructed using a method wherein a core structure of the mattress, whether spring coil or foam encased, is compressed inward and held in place using a preferably non-woven fabric or similar non-elastic or non-stretchable material that is wrapped around the perimeter of the core structure. The method of wrapping the mattress perimeter allows the corners of the mattress to be formed under the inward pressure of the non-woven fabric on the side walls. Further, the preferably non-woven fabric has no elasticity. This creates a strong perimeter for the mattress that prevents outward pressure against the mattress perimeter created by the weight of an individual lying on the mattress, thereby preventing flattening of the mattress by providing more upward pushback against the individual. The flattening of the mattress is prevented whether the user is lying on the center of the mattress or sitting on the edge of the mattress above the mattress perimeter.

An additional benefit of the method of the present invention is that the non-woven fabric encases staples used to secure flanges of the cover to the side walls, thereby preventing the staples from pulling out of the side walls. This is especially important due to the fact that many mattresses are used in adjustable beds wherein the mattresses are bent up and down, thereby making such a staple failure more likely.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
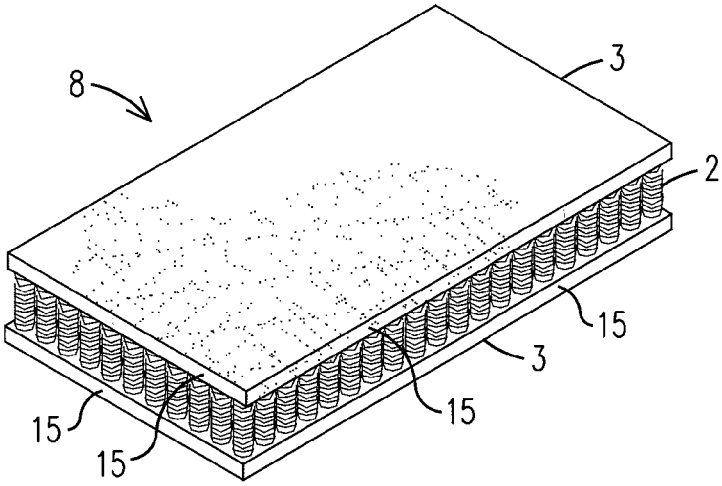
FIG. 1 is a top perspective view of a core structure of a mattress of the present invention having a layer of springs.

For purposes of describing the preferred embodiment, the terminology used in reference to the numbered accessories in the drawings is as follows:

1. mattress of the present invention, generally
2. layer of springs
3. layer of foam
4. edge of foam encasement
5. corner of foam encasement
6. foam encasement

7. foam panel
8. core structure
9. sidewall of foam encasement
10. edge of core structure
11. corner of core structure
12. bottom cover
13. bottom flange
14. perimeter of bottom cover
15. side wall of core structure
16. top cover
17. upper surface of core structure
18. top flange
19. perimeter of top cover
20. staple
21. non-woven strip of fabric
23. outer surface of top flange
24. adhesive
25. first end of non-woven strip of fabric
26. second end of non-woven strip of fabric
27. side cover panels With reference to FIG. 1, a top perspective view of a core structure 8 of a mattress 1 of the present invention having a layer of springs 2 is illustrated. One or more layers of springs 2 may be located between upper and/or lower layers of foam 3. The mattress 1 of the present invention may also have other various materials making up the core structure 8 of the mattress 1, such as air pockets, padding, micro coils, foam, different shaped springs, and so forth. Each material or component of the core structure may either be alone or in combination to make up the core structure 8 structure of the mattress 1.

Figure 2:
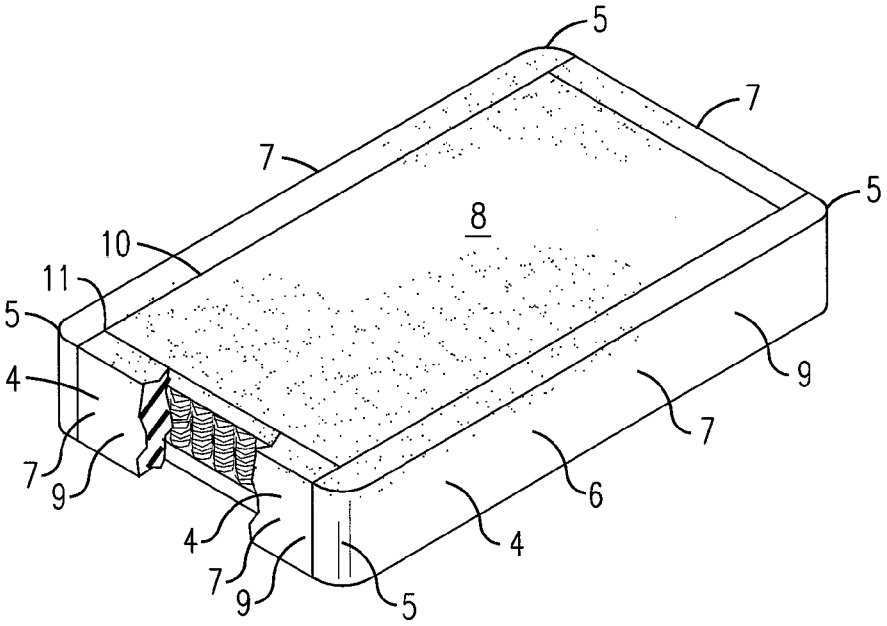
FIG. 2 is a perspective top partial cutaway view of a core structure framed by a foam encasement.
Figure 10:
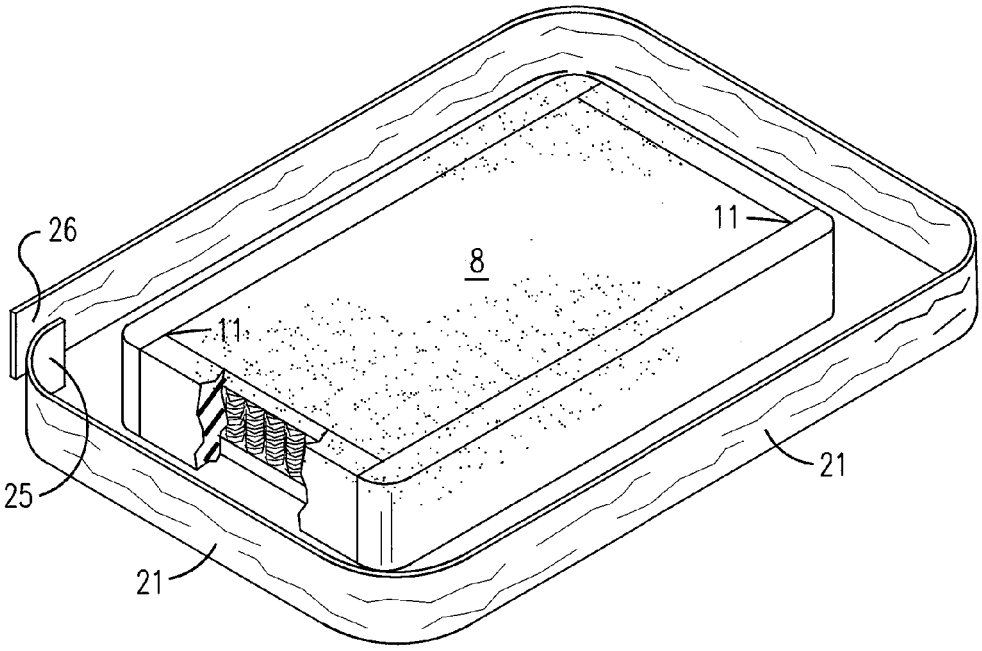
FIG. 10 is a partially exploded top perspective view of a non-woven strip of fabric and core structure of the present invention.

With reference to FIG. 2, a perspective top partial cutaway view of a core structure 8 framed by a foam encasement 6 is illustrated. Edges 10 and corners 11 of the core structure 8 is surrounded and framed by a foam encasement 6 that is constructed out of foam panels 7. As illustrated, the edges 4 of the foam encasement 6 are straight and the corners 5 are smoothly rounded. However, the method of the present invention, it is not necessary for the edges 4 of the foam encasement 6 to be perfectly straight or for the corners 5 to be smoothly rounded. Any imperfections in the foam encasement 6 can be corrected by wrapping a non-woven strip of fabric 21 around the foam encasement 6 with varying degrees of force to apply the proper amount of tension and inward pressure on the side walls 9 and corners 5 of the foam encasement 6 so that the foam encasement 6 is properly formed, as illustrated in FIG. 10.

Figure 3:
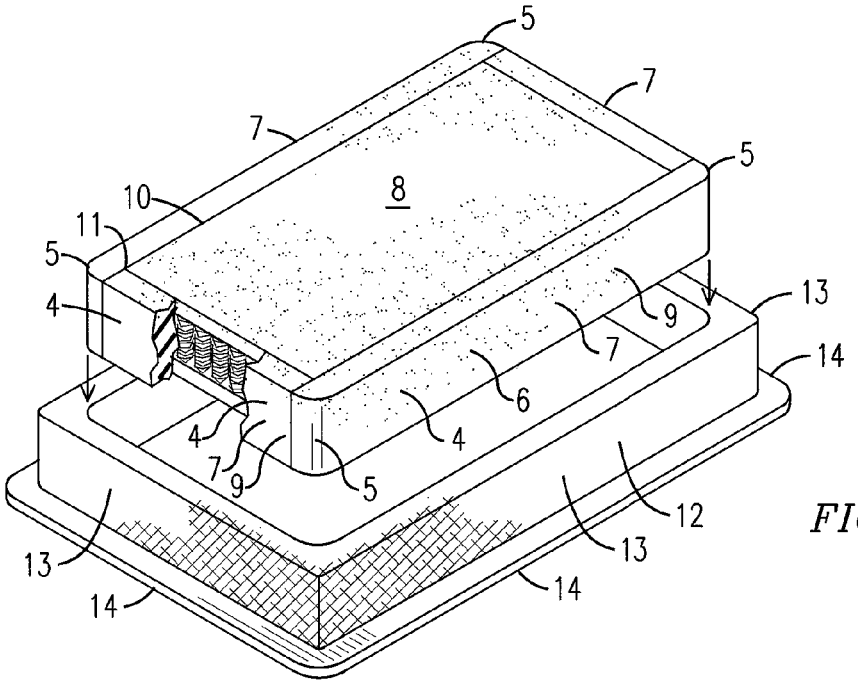
FIG. 3 is an exploded top perspective view of a core structure and foam encasement of the present invention and a bottom cover of the mattress of the present invention.

With reference to FIG. 3, an exploded top perspective view of a core structure 8 and foam encasement 6 of the present invention and a bottom cover 12 of the mattress 1 of the present invention is illustrated. The core structure 8 and foam encasement 6 is placed on top of the bottom cover 12. Then, bottom flanges 13 extending upward from the perimeter 14 of the bottom cover 12 are pulled up around the foam encasement 6.

Figure 4:
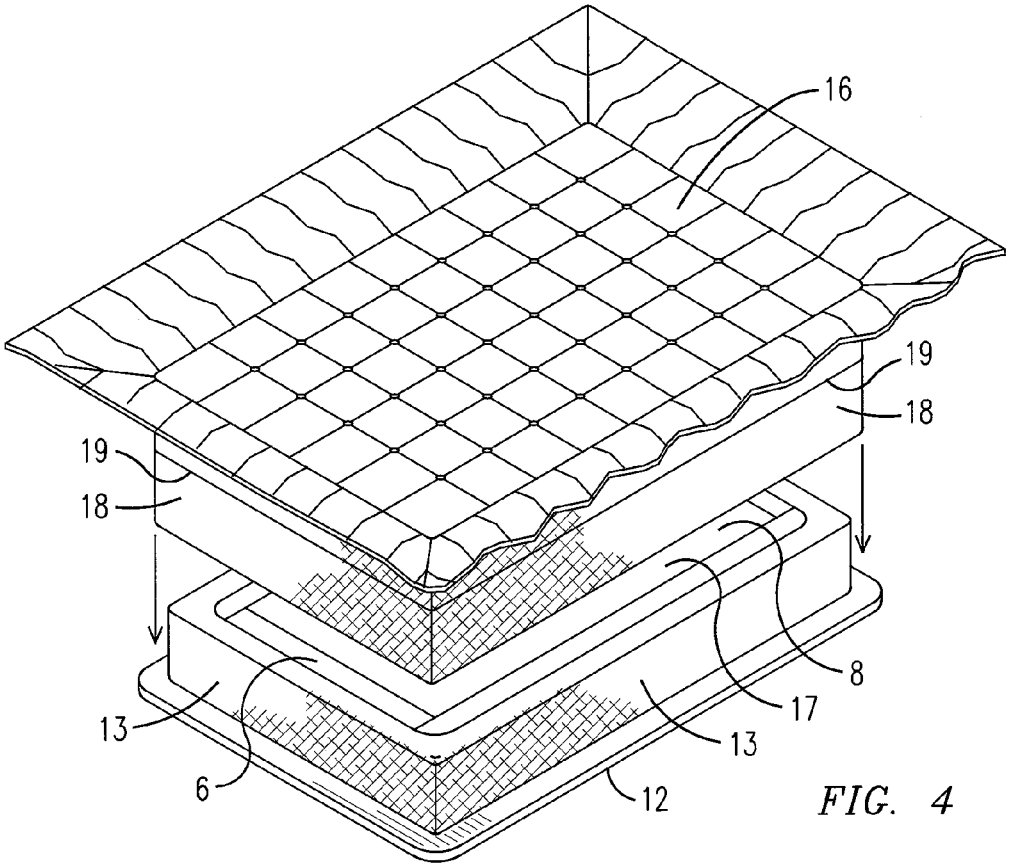
FIG. 4 is a partially exploded top perspective view of a core structure of the present invention already placed in a bottom cover and a top cover of the mattress of the present invention.
Figure 5:
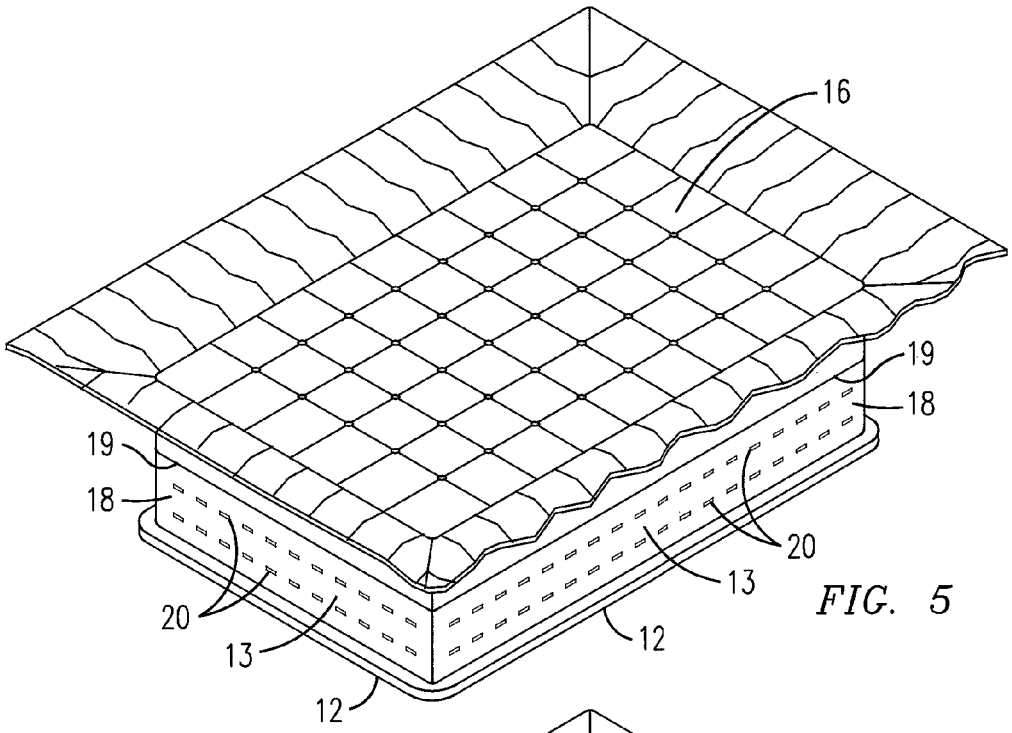
FIG. 5 is a top perspective view of the flanges of the top cover and the flanges of the bottom cover secured to the side walls using staples.
Figure 6:
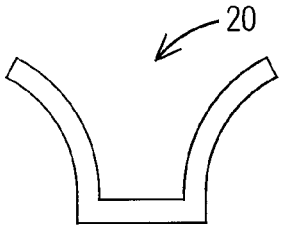
FIG. 6 is a front view of a flair staple.

With reference to FIG. 4, a partially exploded top perspective view of a core structure 8 and foam encasement 6 of the present invention already placed on a bottom cover 12 and a top cover 16 of the mattress 1 of the present invention is illustrated. After the core structure 8 and foam encasement 6 are placed on top of the bottom cover 12 and the bottom flanges 13 of the bottom cover 12 are pulled up around the foam encasement 6, the top cover 16 is placed over an upper surface 17 of the core structure 8 and top flanges 18 extending downward from the perimeter 19 of the top cover 16 are pulled down and around the foam encasement 6 and the bottom flanges 13. The bottom flanges 13 and top flanges 18 are preferably a fabric material. Then, the top flanges 18 and the bottom flanges 13 are secured to the foam encasement 6 by stapling through the flanges 13, 18 into the foam encasement 6, preferably using flair staples 20 that spread apart after entering the core structure 8, as illustrated in FIGS. 5 and 6, respectively.

Figure 7:
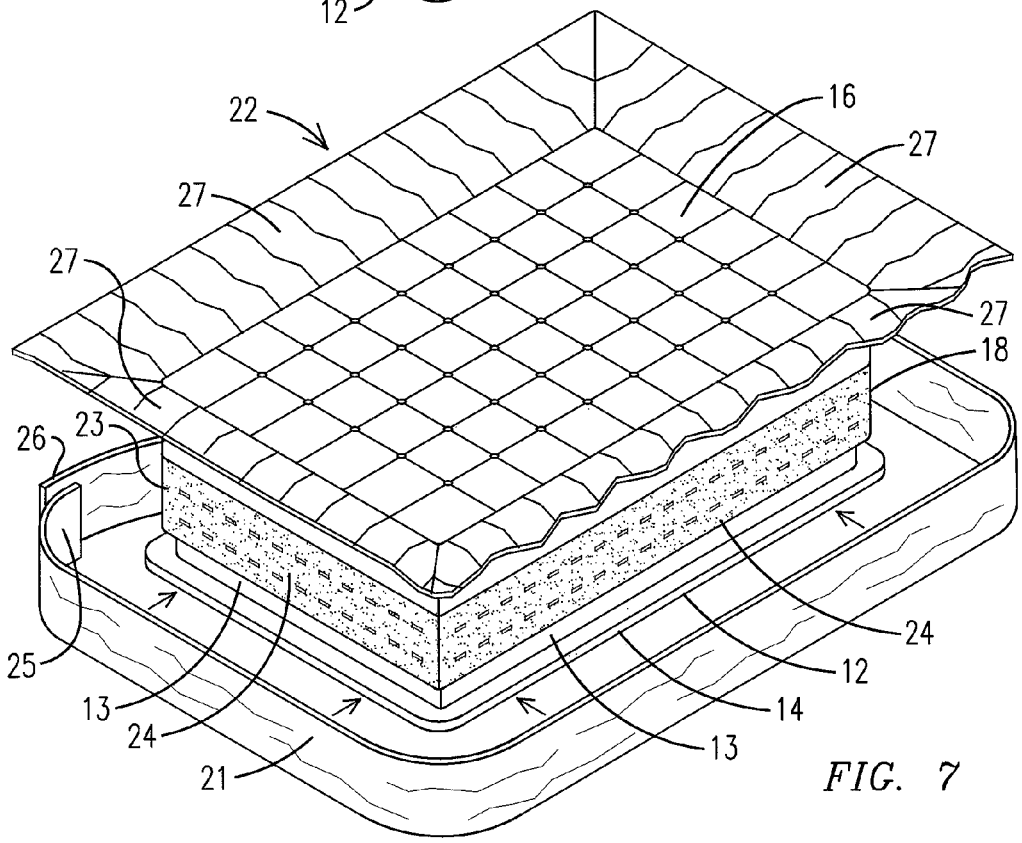
FIG. 7 is a partially exploded top perspective view of a non-woven strip of fabric and mattress of the present invention.
Figure 8:
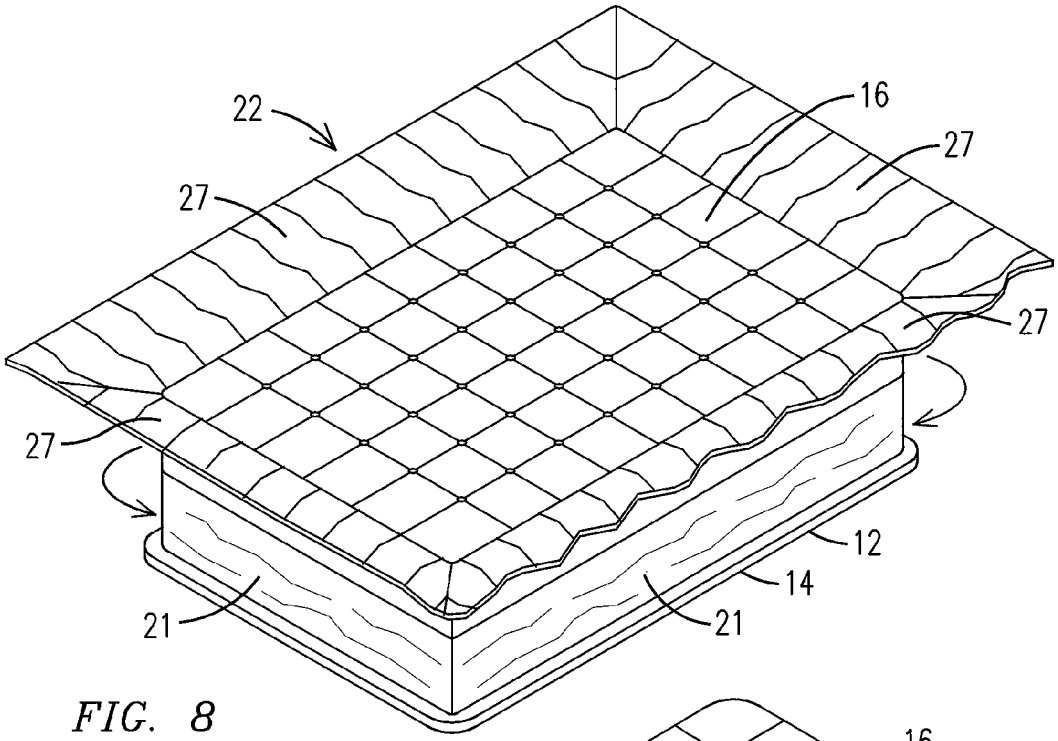
FIG. 8 is a top perspective view of a core structure wrapped in a non-woven strip of fabric of the present invention.
Figure 9:
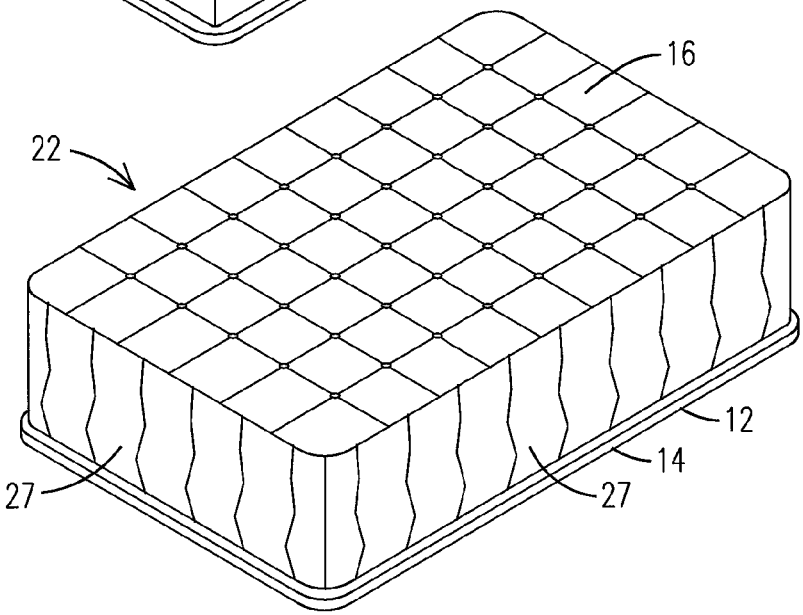
FIG. 9 is a top perspective view of a mattress of the present invention having the side panels of the top cover folded and sewn to the bottom panel.

With reference to FIG. 7, a partially exploded top perspective view of a non-woven strip of fabric 21 and mattress 1 of the present invention is illustrated. After the flanges 13 and 18 are secured to the foam encasement 6, a non-woven strip of fabric 21 or other non-flexible non-stretchable material is secured the outer surface 23 of the top flange 18 using an adhesive 24, such as a water based glue, which may be sprayed on the outer surface 23 of the top flange 18 (or the an outer surface of the bottom flange if the bottom flange is covering the top flange). A first end 25 of the non-woven strip of fabric 21 is then secured to the top flange 18 and wrapped around the foam encasement 6. As the non-woven strip of fabric 21 is wrapped around the foam encasement 6, the non-woven strip of fabric 21 may be pulled with varying degrees of force to apply the proper amount of tension and inward pressure on the side walls 9 and corners 5 of the foam encasement 6 to create straight side walls 7 and properly formed corners 5. Then, a second end 26 of the non-woven strip of fabric 21 is secured to the top flange 18 using the adhesive 24. The non-woven strip of fabric 21 may then be smoothed out. Finally, side cover panels 27 extending from the top cover 16 may be folded down over the non-woven strip of fabric 21 and sewn to the perimeter 14 of the bottom cover 12, thereby completely encapsulating the core structure 8, foam encasement 6, flanges 13, 18 and non-woven strip of fabric 21 in the top cover 16, sided cove panels 27 and the bottom cover 12, as illustrated in FIGS. 8 and 9, respectively.

Figure 11:
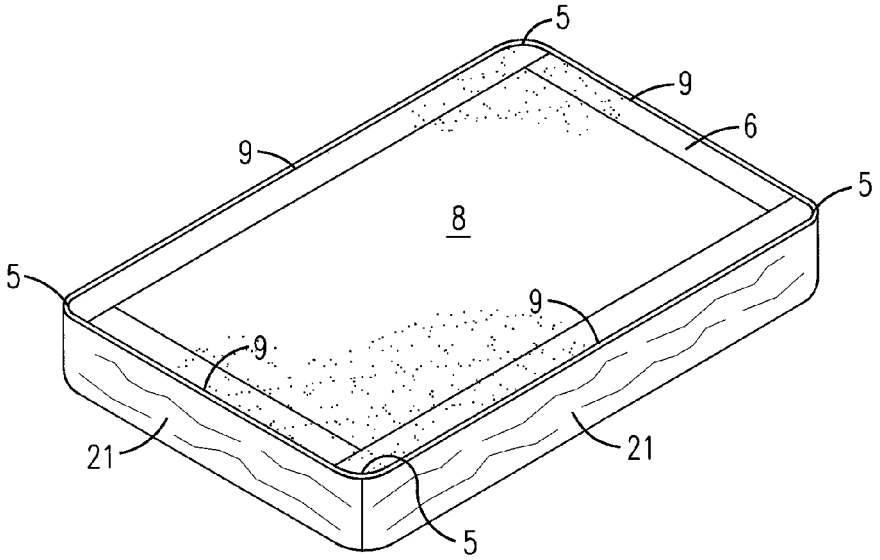
FIG. 11 is a core structure wrapped in non-woven fabric.

With reference to FIG. 10, a partially exploded top perspective view of a non-woven strip of fabric 21, core structure 8 and foam encasement 6 of the present invention is illustrated. The method of the present invention may also be used with other mattress covers, such as sock mattress covers, wherein the foam encasement 6 is directly wrapped with a non-woven strip of fabric 21 or other non-flexible non-stretchable material using an adhesive 24, such as a water based glue, which is sprayed directly on the and foam encasement 6. A first end 25 of the non-woven strip of fabric 21 is then secured to the foam encasement 6 and wrapped around the side walls 7 of the foam encasement 6. As the non-woven strip of fabric 21 is wrapped around the and foam encasement 6, the non-woven strip of fabric 21 may be pulled with varying degrees of force to apply the proper amount of tension and inward pressure on the side walls 9 of the and foam encasement 6 to create straight side walls 9 and properly formed corners 5. Then, a second end 26 of the non-woven strip of fabric 21 is secured using the adhesive 24. The non-woven strip of fabric 21 may then be smoothed out. After the non-woven strip of fabric 21 has been smoothed out, as illustrated in FIG. 11, a cover, such as a sock cover, may be used to cover the wrapped core structure 8 and foam encasement 6.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A perimeter-wrapped mattress comprising:

a substantially rectangular-shaped core structure framed having side walls and corners;

a bottom panel having bottom flanges extending upward from a perimeter edge, thereby surrounding the side walls;

a top panel having top flanges extending downward from a perimeter edge, thereby surrounding the side walls;

a side cover that covers the side walls of the foam encasement to secure the top cover to the bottom cover;

a strip of fabric wrapped around a perimeter of the sidewalls and corners; and said strip of fabric is secured to the side walls using an adhesive.

2. The perimeter-wrapped mattress of claim 1 wherein:

said top flanges and bottom flanges are secured to the side walls using staples.

3. The perimeter-wrapped mattress of claim 1 wherein:

said strip of fabric is a non-woven strip of fabric.

4. The perimeter-wrapped mattress of claim 1 wherein:

said core structure comprises at least one layer of foam.

5. The perimeter-wrapped mattress of claim further comprising:

said core structure comprises at least one layer of springs.

6. A method for manufacturing a perimeter-wrapped mattress having a substantially rectangular-shaped core structure having side walls and corners, said method comprising the steps of:

wrapping the side walls and corners with a strip of fabric while exerting an inward pressure on the side walls and corners to create properly formed corners and side walls on the core structure; and said strip of fabric is secured to the side walls using an adhesive.

7. The method of claim 6 further comprising the steps of:

placing the core structure on a bottom panel having bottom flanges extending upward from a perimeter edge; and folding the bottom flanges upward, thereby surrounding the side walls.

8. The method of claim 6 further comprising the steps of:

placing a top panel having top flanges extending downward from a perimeter edge; and folding the top flanges downward, thereby surrounding the side walls.

9. The method of claim 7 further comprising the step of:

securing a side cover to the perimeter edge of the bottom panel.

10. The method of claim 8 further comprising the step of:

securing a side cover to the perimeter edge of the top panel.

11. The method of claim 6 wherein:

said strip of fabric is a non-woven strip of fabric.

12. The method of claim 6 wherein:

said core structure comprises at least one layer of foam.

13. The method of claim 6 wherein:

at least one micro-coil layer located in the foam core.

14. A system for manufacturing a perimeter-wrapped mattress having a substantially rectangular-shaped core structure having side walls and corners, said system comprising:

side walls and corners being wrapped with a strip of fabric while exerting an inward pressure on the side walls and corners to create properly formed corners and side walls on the core structure;

said strip of fabric being secured to the side walls using an adhesive and the core structure being placed on a bottom panel having bottom flanges extending upward from a perimeter edge; and the bottom flanges being folded upward, thereby surrounding the side walls.

15. The system of claim 14 further comprising the steps of:

a top panel having top flanges extending downward from a perimeter edge; and the top flanges being folded downward, thereby surrounding the side walls.

16. The system of claim 14 further comprising the step of:

a side cover being secured to the perimeter edge of the bottom panel.

17. The system of claim 15 further comprising the step of:

a side cover being secured to the perimeter edge of the top panel.

18. The system of claim 14 wherein:

said strip of fabric is a non-woven strip of fabric.

19. The system of claim 14 wherein:

said core structure comprises at least one layer of foam.

20. The system of claim 14 wherein:

said core structure comprises at least one layer of springs.

21. A system for manufacturing a perimeter-wrapped mattress having a substantially rectangular-shaped core structure having side walls and corners, said system comprising:

side walls and corners being wrapped with a strip of fabric while exerting an inward pressure on the side walls and corners to create properly formed corners and side walls on the core structure;

said strip of fabric being secured to the side walls using an adhesive;

a top panel having top flanges extending downward from a perimeter edge;

the top flanges being folded downward, thereby surrounding the side walls; and a side cover being secured to the perimeter edge of the top panel.

* * * * *